US009675837B2

(12) United States Patent
Smith

(10) Patent No.: US 9,675,837 B2
(45) Date of Patent: Jun. 13, 2017

(54) THERAPEUTIC STICK AND METHOD OF USE

(71) Applicant: Daniel Smith, West Nyack, NY (US)

(72) Inventor: Daniel Smith, West Nyack, NY (US)

( * ) Notice: Subject to any disclaimer, the term of this patent is extended or adjusted under 35 U.S.C. 154(b) by 0 days.

(21) Appl. No.: 15/335,509

(22) Filed: Oct. 27, 2016

(65) Prior Publication Data

US 2017/0120100 A1 May 4, 2017

Related U.S. Application Data

(60) Provisional application No. 62/247,312, filed on Oct. 28, 2015.

(51) Int. Cl.

| | |
|---|---|
| ***A63B 21/02*** | (2006.01) |
| ***A63B 21/00*** | (2006.01) |
| ***A63B 23/02*** | (2006.01) |
| ***A63B 23/025*** | (2006.01) |
| ***A63B 23/04*** | (2006.01) |
| ***A63B 23/16*** | (2006.01) |
| ***A63B 69/00*** | (2006.01) |
| ***A63B 69/36*** | (2006.01) |
| *A63B 23/00* | (2006.01) |

(52) U.S. Cl.

CPC ..... *A63B 21/4035* (2015.10); *A63B 21/02* (2013.01); *A63B 23/0205* (2013.01); *A63B 23/025* (2013.01); *A63B 23/04* (2013.01); *A63B 23/16* (2013.01); *A63B 69/002* (2013.01); *A63B 69/0002* (2013.01); *A63B 69/36* (2013.01); *A63B 2023/006* (2013.01); *A63B 2069/0006* (2013.01); *A63B 2209/02* (2013.01)

(58) Field of Classification Search

CPC . A63B 21/4035; A63B 21/02; A63B 21/4043; A63B 21/068; A63B 23/03541; A63B 21/00065; A63B 21/00043; A63B 2023/006; A63B 21/0724; A63B 21/0004; A63B 21/00069; A63B 21/0428; A63B 23/03508; A63B 23/12

USPC ..... 482/110, 126, 139; D21/679

See application file for complete search history.

(56) References Cited

U.S. PATENT DOCUMENTS

| | | | | |
|---|---|---|---|---|
| 1,714,391 A * | 5/1929 | McWhirter | ..... | A63B 21/015 482/148 |
| D351,878 S * | 10/1994 | Globus | ..... | D21/679 |
| 5,776,083 A | 7/1998 | Jacob et al. | | |
| 5,868,651 A * | 2/1999 | Washington | ..... | A63B 21/00043 482/122 |
| 7,022,046 B2 * | 4/2006 | Kim | ..... | A63B 21/00043 482/1 |

(Continued)

OTHER PUBLICATIONS

International Search Report and Written Opinion mailed Jan. 27, 2017, 14 pages.

*Primary Examiner* — Andrew S Lo

(74) *Attorney, Agent, or Firm* — Gearhart Law LLC

(57) ABSTRACT

An apparatus for improving flexibility and its method of use are provided. The apparatus features a flexible member, which can have varying degrees of stiffness and flexibility, based on user preference. Further, the apparatus features a first and second auxiliary grip, as well as a first and second primary grip. In conjunction, these grips provide a vast multitude of ways to grip the apparatus, enabling it to be used in a wide variety of stretches and exercises, promoting strength as well as joint mobility and flexibility.

27 Claims, 7 Drawing Sheets

(56) References Cited

U.S. PATENT DOCUMENTS 7,108,646 B1 9/2006 Quick
7,641,566 B2 * 1/2010 O'Connor ..... A63B 21/0004 473/197
7,922,634 B1 * 4/2011 Wu ..... A63B 21/0004 482/121
7,951,051 B1 * 5/2011 Brown ..... A63B 21/0004 482/111
8,083,643 B2 * 12/2011 Ng ..... G06Q 10/02 482/1
8,092,354 B2 1/2012 Oller, Jr.
8,103,517 B2 * 1/2012 Hinnebusch ..... A63B 24/0084 482/4
8,597,166 B2 12/2013 Klein
8,956,290 B2 * 2/2015 Gilley ..... G06Q 10/06 128/920
D733,226 S * 6/2015 Abbate ..... D21/679
2002/0198081 A1 * 12/2002 Chen ..... A63B 21/0004 482/23
2003/0199371 A1 10/2003 Rigouby
2004/0132592 A1 * 7/2004 Yu ..... A63B 21/0004 482/126
2004/0180764 A1 9/2004 Patton
2004/0185990 A1 * 9/2004 Orescan ..... A63B 21/0552 482/126
2004/0242387 A1 * 12/2004 Benach ..... A63B 21/00043 482/126
2005/0113221 A1 * 5/2005 Dovner ..... A63B 21/0004 482/121
2005/0113223 A1 * 5/2005 Dovner ..... A63B 21/0004 482/121
2006/0135330 A1 * 6/2006 Clark ..... A63B 23/12 482/139
2007/0111865 A1 5/2007 Patton
2007/0135275 A1 * 6/2007 Oates ..... A63B 21/0004 482/109
2007/0184946 A1 * 8/2007 Kuhagen ..... A63B 21/02 482/110
2007/0275834 A1 * 11/2007 Reilly ..... A63B 15/00 482/91
2008/0081747 A1 * 4/2008 Mok ..... A63B 21/0004 482/121
2008/0287272 A1 * 11/2008 Luckadue ..... A63B 21/027 482/107
2009/0264267 A1 * 10/2009 Ballif ..... A63B 21/0004 482/139
2010/0009822 A1 * 1/2010 Holleman ..... A63B 21/0004 482/126
2010/0240505 A1 * 9/2010 Yang ..... A63B 21/0004 482/126
2012/0077648 A1 * 3/2012 Farrow ..... A63B 21/028 482/110
2012/0322632 A1 * 12/2012 Kezer ..... A45B 9/00 482/121
2013/0029811 A1 * 1/2013 Lando ..... A63B 21/023 482/121
2013/0267394 A1 * 10/2013 Duke ..... A63B 21/0608 482/110
2013/0296145 A1 * 11/2013 Tomaszewski ..... A63B 21/06 482/106
2014/0080687 A1 * 3/2014 Stuef ..... A63B 21/04 482/129
2014/0121074 A1 * 5/2014 Cojocaru ..... A63B 21/0724 482/106
2014/0121075 A1 * 5/2014 Brown ..... A63B 21/026 482/106
2016/0030801 A1 * 2/2016 Porto ..... A63B 21/1469 482/139
2016/0325134 A1 * 11/2016 Riccoboni ..... A63B 22/0002

* cited by examiner

THERAPEUTIC STICK AND METHOD OF USE

CLAIM OF PRIORITY

This application claims priority to U.S. Application 62/247,312 filed on Oct. 28, 2015, the contents of which is herein fully incorporated by reference in its entirety.

FIELD OF THE EMBODIMENTS

The field of the present invention and its embodiments relate to a therapeutic stick. In particular, the present invention and its embodiments relate to a flexible therapeutic stick with a plurality of handle attachments.

Background of the Embodiments

In today's world, getting hurt on and off the job has unfortunately become common place. Injuries can range from carpel tunnel to a broken back, to everything in between. While modern medicine has advanced to a point where almost any ailment can be treated, the cost of these treats has advanced in kind. Further, getting hurt off the job can have serious consequences on keeping said job, which can help pay for medical treatment. As such, many of the people who experience the commonplace occurrence of getting hurt, are unable to afford the care they need to return to work. Creating a vicious cycle where the individual gets hurt so they can no longer work, but because they can no longer work they cannot afford the care their need to get better, leaves a lot of the American public in a state where they cannot work, and cannot afford to get better. For this reason there is a need for an inexpensive solution that allows people to regain mobility, increase strength, and return to the job without having to break the bank.

Review of Related Technology

U.S. Pat. No. 4,556,011 pertains to a multifluid dispensing system especially suited for web tinting machines or the like. A plurality of fluid and, optionally, air-tight tanks are provided. In a recirculating embodiment, the tanks feed fluid to, and receive fluid from, two manifolds. The upper (output) manifold receiving fluid from each tank slopes to gravity drain into the second manifold. The second (inlet) manifold is level to eliminate low spots for fluid accumulation. The inlet manifold drains into the tanks through valves in the side of, and level with, the manifold. A non-recirculating embodiment uses only the second manifold with pressurized tanks. An optional flush tank may be provided.

U.S. Pat. No. 5,776,083 pertains to an exercise bar for use in rehabilitative therapy of joint structures, especially those of an impaired limb of a user. The exercise bar preferably comprises an elongated shaft having a longitudinal axis and two ends, a loop member comprising a loop attached to a first end of the shaft, and a handle member attached to a second end of the shaft at an angle to both the longitudinal axis of the shaft and the plane defined by the loop of the loop member. The loop preferably is in the shape of an isosceles triangle with the angles forming arcuated notches for receiving a portion of the user's impaired limb. Once the user's limb is seated within one of the notches, the shaft may be rotated about it axis to enable rotational, resistive stretching of a first joint complex or may be reciprocated along its axis to enable the performance of various exercises.

U.S. Pat. No. 7,108,646 pertains to an infant exercise cushion including a substantially rigid core element preferably in the form of a hollow pipe. A soft resilient material surrounds a substantial portion of the core element. The soft resilient material forms a curved outer surface for the cushion so that the cushion may be rolled on the floor when there is interface between the infant and the cushion.

U.S. Pat. No. 8,092,354 pertains to an exercise apparatus for use in stretching. The exercise apparatus includes a compact construction that is mechanically easy to operate and allows users to gently stretch, without assistance from others. The exercise apparatus includes a tubular member and a shaft member that is sized to slidably insert into the tubular member to form a telescoping structure that extends in a longitudinal direction. A base is provided having a substantially planar shape that includes an upper surface adapted to receive a force applied in a downward direction. The force is provided to supplement an initial force received through the connector.

U.S. Pat. No. 8,597,166 pertains to a method for producing a fitness apparatus having the following components: a flexible bar which can be set in oscillation upon operation of the fitness apparatus by a user, a grip area arranged centrally on the flexible bar for the user to hold the fitness apparatus and end caps arranged at both ends of the flexible bar, wherein the method includes the following method steps: arranging at least one respective end weight at the ends of the flexible bar, inserting the flexible bar with the end weights arranged thereon into a first molding tool to form the end caps, foaming out of the first molding tool with a first foam material to produce at least the end caps and subsequent hardening of the first foam material. The invention also relates to a fitness apparatus produced in particular with the inventive method.

U.S. Patent Publication No.: 2003/0199371 pertains to an exercise apparatus comprising one or more pair of grasping sections and one or more extensible sections to enable the apparatus to be stretched to an extended length from an un-extended length.

U.S. Patent Publication No.: 2004/0180764 pertains to an apparatus for stretching and strengthening muscles from a standing or seated position with a support member having a top end and a bottom end, the top end providing a location for grasping, the bottom end providing a base surface for force distribution and support. A preferred embodiment includes the support member which is adjustable in length such that the distance between the top end and the bottom end is adjustable. A preferred embodiment includes a way for fixedly securing the adjustable support member at desired lengths.

U.S. Patent Publication No.: 2007/0111865 pertains to an apparatus for stretching and strengthening muscles from a standing or seated position with a support member having a top end and a bottom end, the top end providing a location for grasping, the bottom end providing a base surface for force distribution and support. A preferred embodiment includes the support member which is adjustable in length such that the distance between the top end and the bottom end is adjustable. A preferred embodiment includes a way for fixedly securing the adjustable support member at desired lengths.

Various systems and methodologies are known in the art. However, their structure and means of operation are substantially different from the present disclosure. The other inventions fail to solve all the problems taught by the present disclosure. At least one embodiment of this invention is presented in the drawings below and will be described in more detail herein.

SUMMARY OF THE EMBODIMENTS

The present invention provides for a therapeutic stick, comprising: a flexible member, having a length, a diameter, a first end and a second end, wherein said flexible member is enveloped by padding; a first auxiliary grip, disposed proximate to said first end; a second auxiliary grip, disposed proximate to said second end; a first primary grip, disposed on said first end; a second primary grip; disposed on said second end. In some embodiments this first primary grip and/or said second primary grip are removably attached to said flexible member. Preferably, said first primary grip and/or said second primary grip are spherical or substantially spherical. In a highly preferred embodiment, said first primary grip and/or said second primary grip are spheres having a 3" diameter, wherein said spheres have at least 25% of their area removed.

The present invention allows a football player to stretch his legs, neck and abs, allows a golfer to target his swing with lower back, lats, and/or shoulders exercises, allows a baseball pitcher to work on rotator cuff and hand strength, allows an elderly person to work on a hunch back or a frozen shoulder, and allows a wounded veteran to work on increasing mobility from their bed. The present invention supports the wounded part of the body so that the muscles around the injury can still be used and not become atrophic and weak. It builds the core muscles while strengthening smaller stabilizer muscles throughout the back and body. Further, the present invention has the potential to systematically alleviate the need for dozens of narrow use devices. Much like the benefits achieved from yoga, the present invention is capable of increasing the stability and strength of each muscle in the human body. For example, the present invention is used for building the core and stabilizing muscles in a user's torso, affording a user more strength, stamina, a steadier, more consistent gait, and more flexibility. The present invention allows a user to mobilize their joints while stretching them and strengthening the proximate muscle, relieving stiffness in these joints.

In general, the present invention succeeds in conferring the following, and others not mentioned, benefits and objectives:

It is an object of the present invention to provide an inexpensive and high performing option available to all those who need it.

It is an object of the present invention to provide assistance to those with limited mobility.

It is an object of the present invention to ensure that veterans have the opportunity to safely rehab at their home or hospital.

It is an object of the present invention to provide a means to increase strength and flexibility.

It is an object of the present invention to provide a means to assist in building muscle such that weakened muscles will be supported.

It is an object to assist the healing of injured to avoid, decrease, or eliminate a user's need for pain medication, especially opiate based medications.

DESCRIPTION OF THE PREFERRED EMBODIMENTS

Figure 1:
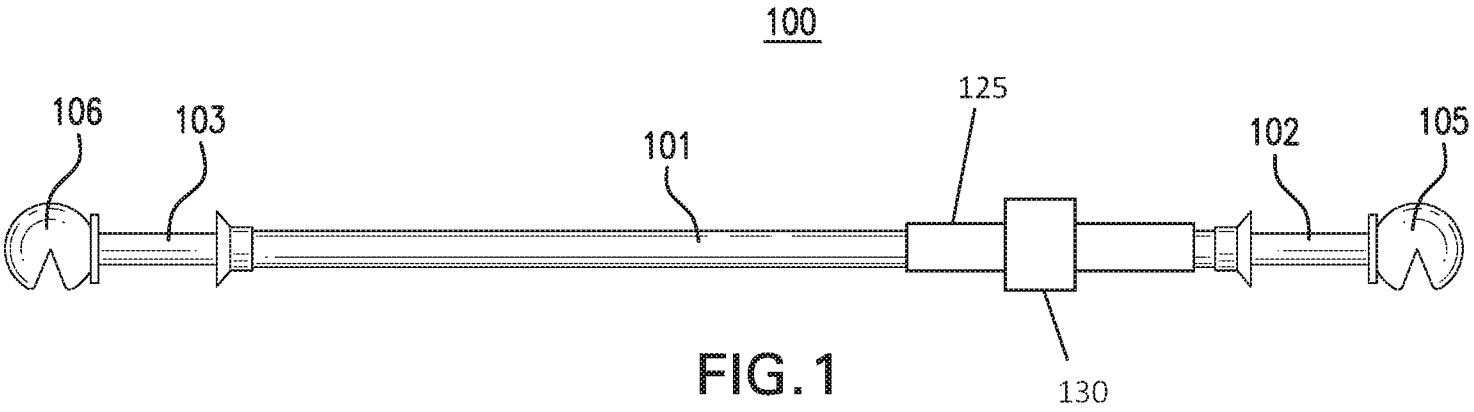
FIG. 1 shows a top view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As a threshold matter, the terms "grip" and "handle" can be used interchangeably, for the purposes of this disclosure.

Referring to FIG. 1, a top view of an embodiment of the present invention is provided. Here, therapeutic stick 100 has a number of components. Called out by the instant figure are flexible member 101, first auxiliary grip (handle) 102, second auxiliary grip 103, first primary grip 105, and second primary grip 106.

As can be seen here, both first primary grip 105 and second primary grip 106 are comprised of spheres. Preferably, these spheres will have a 3" diameter. More preferably, these spheres will have a 3" diameter, but will then have at least 25% of the volume removed. This is to accommodate either first primary grip 105 or second primary grip 106 being interfaced with the heel of a foot or the arch of the foot of a user. This provides for the use of therapeutic stick 100 in a variety of leg stretches, as well as for helping us assorted assisted therapies. Further, the spherical handle cut outs will provide overall increased ergonomics, functionality, and efficiency of workouts involving the therapeutic stick 100. However, primary grip 105 and secondary grip 106 may comprise an assortment of handles and grips to suit a user's needs. In some embodiments, the grip is a "shovel" type handle.

Preferably, the reduced-volume spheres may be readily interchanged with any other embodiment of first primary grip 105 or second primary grip 106. However, first primary grip 105 or second primary grip 106 may also be permanently attached to flexible member 101. Flexible member 101 has a length and a diameter. Preferably, this length will be 52", 56", or 60". These values correlate to 80% of the wingspan of the average American male, the average American female, and that of the inventor, respectively. Alternatively, the length of the stick may be customized to fit the proportions of a given user. Preferably, this length will correlate to 80% of the wingspan of a user, although it could corresponded to 100% of the wingspan of a user, or some other predetermined value. Overall, the length of the therapeutic stick 100 may be about 50% to about 90% of the wingspan of the average American male or American female. In other embodiments, the length of the therapeutic stick 100 may be about 50% to 100% of the wingspan of the individual user.

Should a user attempt to use a stick that does not meet the aforementioned optimized proportions, they may use first auxiliary grip 102 or second auxiliary grip 103 in lieu of first primary grip 105 and second primary grip 106.

Flexible member 101 is intended to be flexible, but only to a particular degree. In various embodiments, flexible member 101 has a wide array of stiffness and flexibility. This flexibility is an important distinguishing feature of therapeutic stick 100 compared to any other rigid member. In an alternative embodiment, flexible member 101 may be stiffer, providing larger resistance to a user. This increases the uses of therapeutic stick 100 such that it may now be used for high-strength resistance training.

Figure 2:
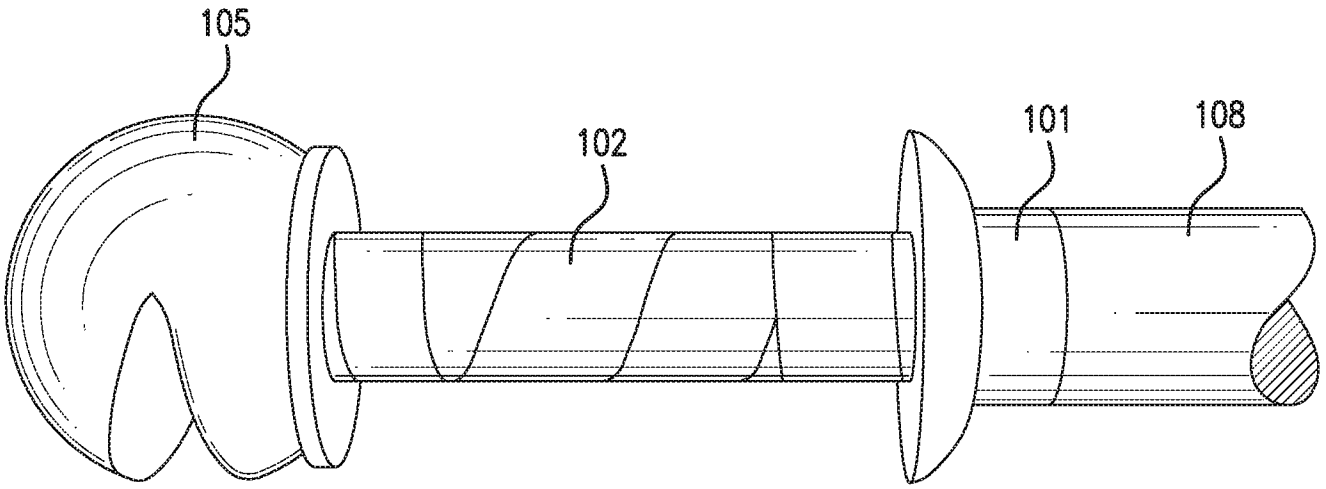
FIG. 2 shows a top view of an embodiment of a primary and auxiliary handle of the present invention.

FIG. 2 shows a top view of an embodiment of a primary and auxiliary handle of the present invention. Here, flexible member 101, first auxiliary grip 102, first primary grip 105 and padding 108 are shown. Of note is the distinction between flexible member 101, and padding 108. While padding 108 is shown here, there are many embodiments where it is not part of the present invention. Further, the particular embodiment shown by FIG. 2, features a rotating primary grip 105. That is, first primary grip 105 can rotate freely about flexible member 1. This may be achieved via ball bearings, a nut and bolt, or any other commercially viable mechanism. Preferably first primary grip 105 is detachable.

In some embodiments, first primary grip 105 is attached via a male/female threaded assembly, and in other embodiments first primary grip 105 is attached via a clamp. It should be noted that features and limitations pertaining to first primary grip 105 also pertain to second primary grip 106 (see FIG. 1). Further, this particular embodiment of first primary grip 105 allows the grip to be pulled away from first auxiliary grip 102, such that the length of the present invention is deviated. Moreover, in other embodiments, the present invention may be equipped with a sphere first primary grip 105 and a different grip for second primary grip 106 (see FIG. 1).

Figure 3:
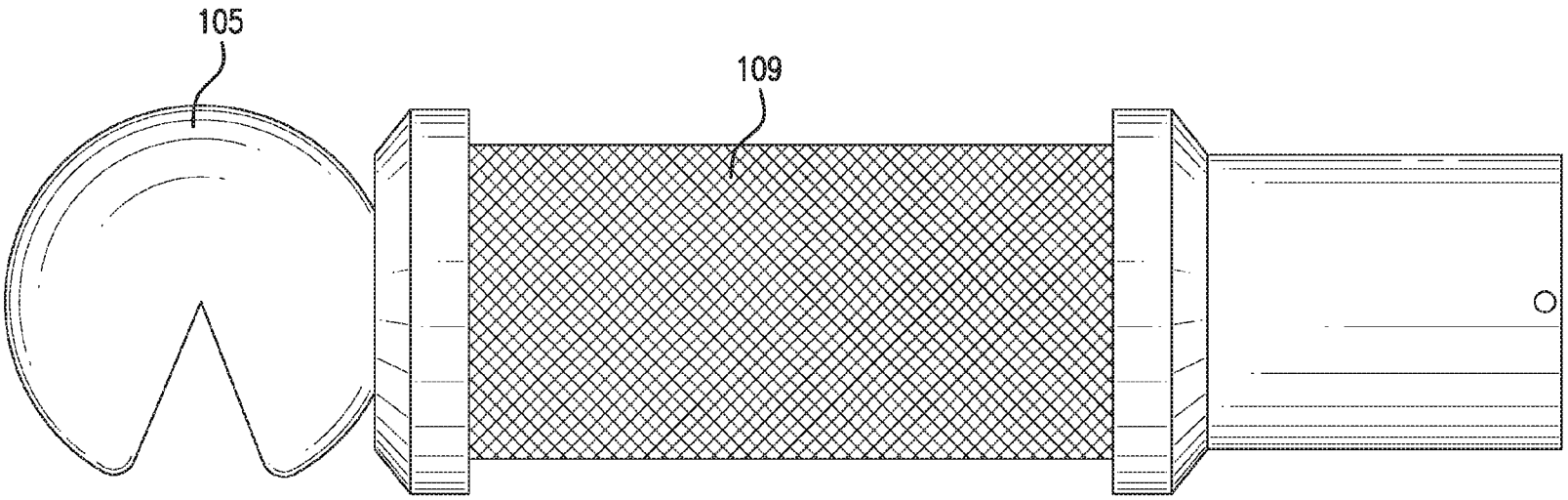
FIG. 3 shows an illustration of an embodiment of a junction between a primary handle and the flexible member of the present invention.

Referring to FIG. 3, an illustration of an embodiment of a junction between a primary handle and the flexible member of the present invention is shown. In this embodiment, first auxiliary handle 102 (see FIG. 2) is coated in rubber 109. Rubber coating 109 provides a high coefficient of static friction, allowing a user to more easily wield and manipulate the present invention. Further, rubber coating 109 is preferably malleable, so that a user may comfortably grip the present invention without fatiguing. In some embodiments rubber coating 109 is permanently fixed to first auxiliary grip, while in other embodiments it may rotate about the grip, providing a different range of motion than the fixed variant.

Figure 4A:
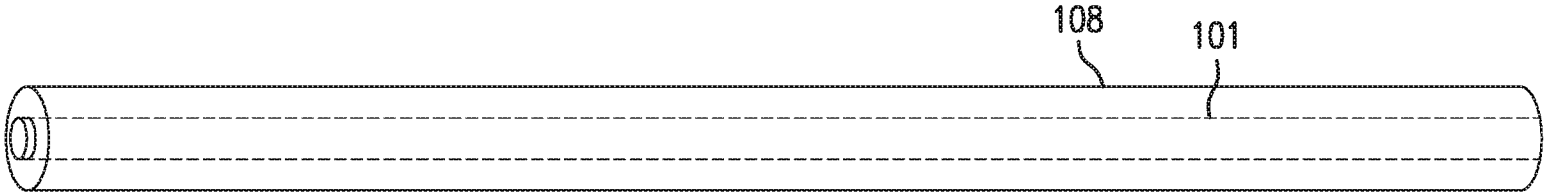
FIGS. 4A and 4B show an x-ray side and front view of an embodiment of the flexible member of the present invention.
Figure 4B:
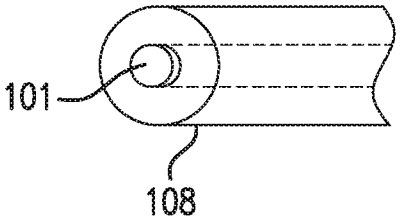

FIGS. 4A and 4B show an x-ray side and front view of an embodiment of the flexible member of the present invention. These figures show the relationship of flexible member 101 and padding 108. Preferably, padding 108 has a diameter of 1", with a hole having a diameter of ⅜" in the center to receive flexible member 101. Here, flexible member is 46" long, but as mentioned above it can have a wide range of lengths. Further, flexible member preferably has a diameter of ⅜", but may also have diameters as small as ⅛", or as high as 2", depending on the material used to construct flexible member 101, as well as the desired amount of resistance a user would like the present invention to provide. In some embodiments, padding 108 may have at least one indicator on it. For example, the at least one indicator may show a scale of 5 to 0 to 5 (-4-3-2-1-0-1-2-3-4-5, where 0 is the center of the stick, and by moving your position relative to the chart, you may exert predetermined levels of resistance. This can have substantial benefit in allowing a patient to follow an exercise regime.

Figure 5:
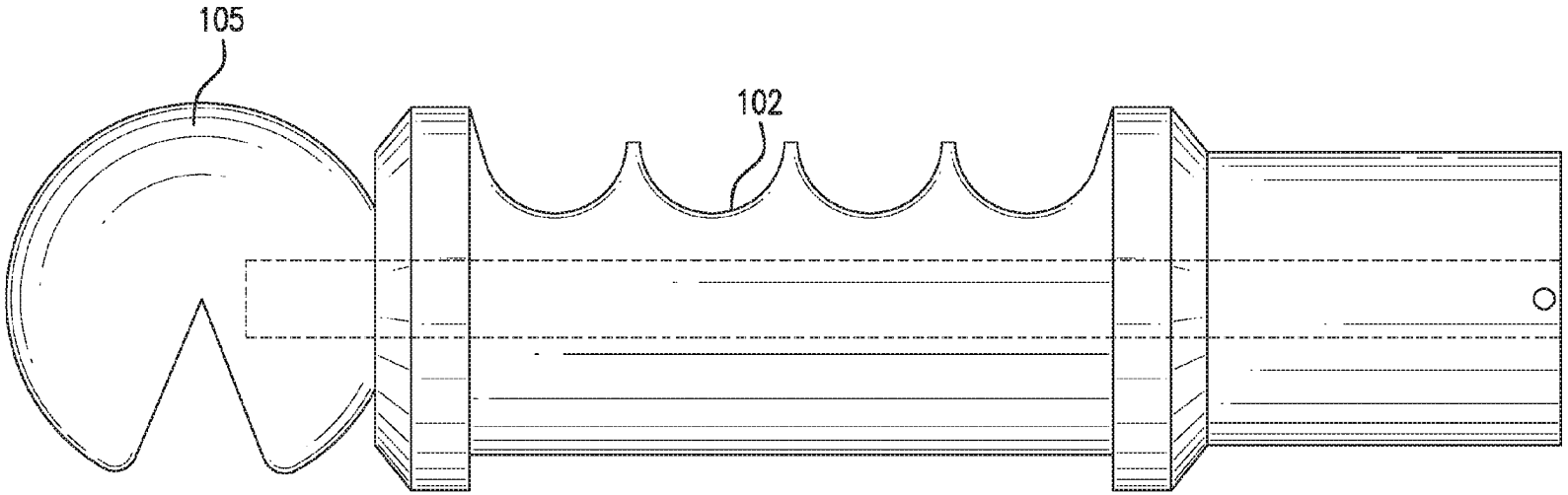
FIG. 5 shows an alternative embodiment of a primary and auxiliary handle of the present invention.

Turning to FIG. 5, an alternative embodiment of a primary and auxiliary handle of the present invention. Of note here is the alternative configuration of first auxiliary handle 102. Here, first auxiliary handle 102 is equipped with a plurality of indentations which correlate to a human hand. In some embodiments, first auxiliary handle is a standardized size, intended to comfortably accommodate a large subset of the earth's population. One such standardized length is 4¾", as shown by FIG. 5. Alternatively, custom-made first auxiliary handles 102 may be used which are perfectly molded to a given user's hand.

In other embodiments, a wide variety of attachments may take the place of either first auxiliary handle 102, first primary handle 105, or flexible member 101. Such attachments include, a handle grip; a ball-like grip such as, a football, basketball, or baseball; a hand-shaped grip resembling a glove; a strap that wraps around a user's hand; a hook, a geometric shape; a hoop; a door/wall/floor adapter for resistance or stability; a suction cup; a heating element; a cooling element; and a vibrating massage apparatus. In other embodiments, the present invention may be equipped with at least one speaker.

Figure 6:
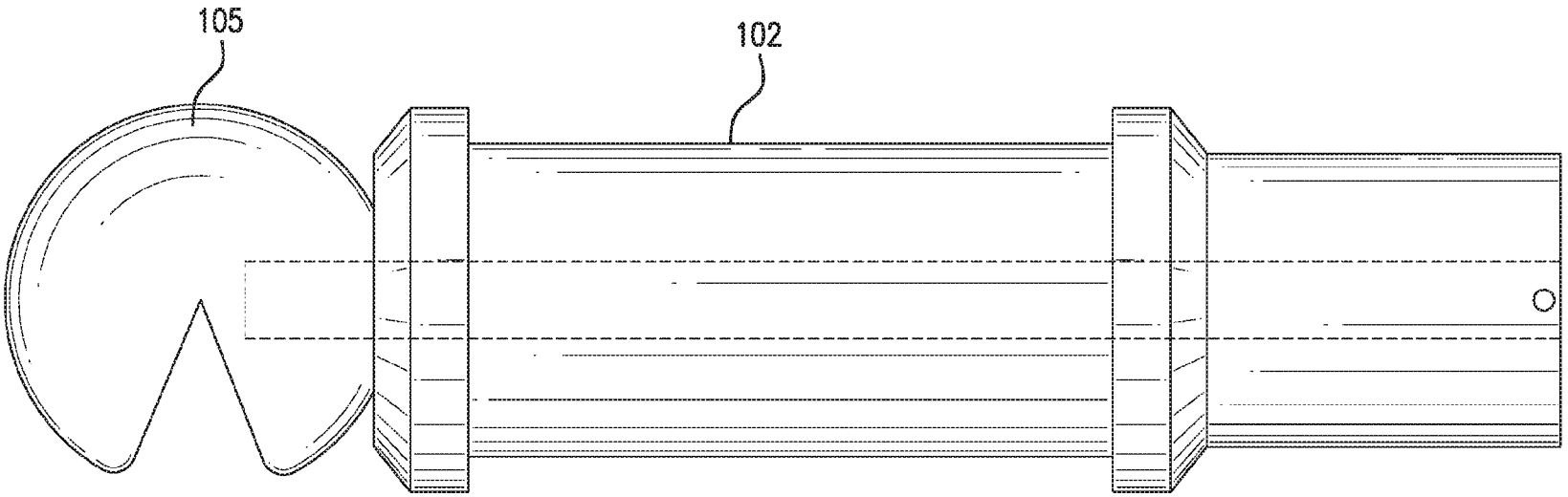
FIG. 6 shows another embodiment of a primary and auxiliary handle of the present invention.

Referring to FIG. 6, another embodiment of a primary and auxiliary handle of the present invention. Here, first auxiliary handle 102 is fixed to first primary handle 105. This is a simple construction, but is beneficial because there are less moving parts, and the cost of construction is significantly reduced. The present invention may be constructed out of a variety of materials. For example, both primary grips and auxiliary grips may be constructed out of rubber, PET, PVA, PVC, aluminum, steel, brass, wood, the like, or some combination thereof. In various embodiments, the surfaces of all the components of the present invention may have a smooth, tacky, rough, bumpy, soft or hard finish. In alternative embodiments, the various attachments of the present invention may be constructed out of plastic, rubber, composite, cloth, foam, stone, wood, and hemp. In further embodiments, the present invention comprises a strap, and an adapter that allowed the present invention to be interfaced with a wall, floor, and/or door.

Figure 7A:
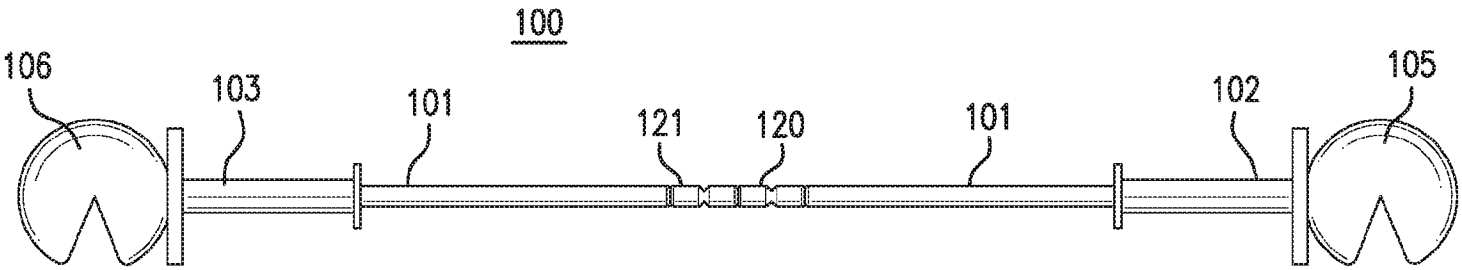
FIG. 7A is a side view of another embodiment of the present invention.
Figure 7B:
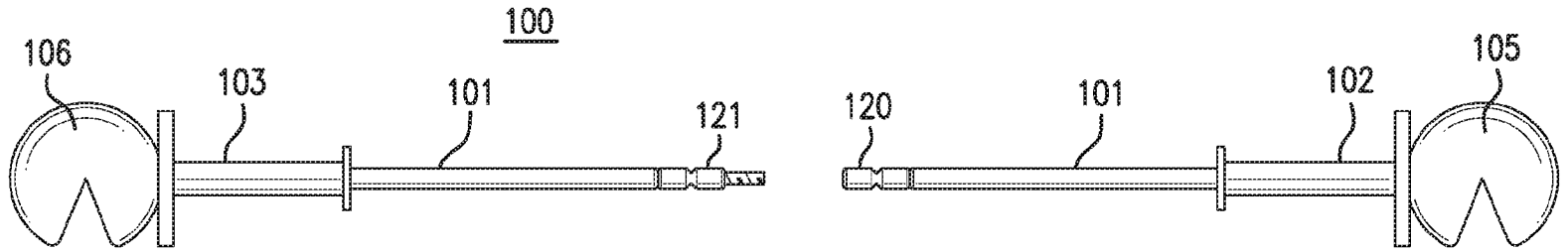
FIG. 7B is an exploded side of the embodiment shown in FIG. 7A.

Referring now to FIGS. 7A and 7B, the therapeutic stick 100 has a primary handle 105, flexible member 101, first auxiliary handle 102, second auxiliary handle 103, first primary grip 105, and second primary grip 106. Further, there is a male member 121 and a female member 120. As shown in FIG. 7B, the male member 121 and female member 120 may be coupled to one another or uncoupled thereby forming two distinct portions of the therapeutic stick 100. This may be particularly useful for storage or traveling. Further, the sections may be utilized, in some instances, individually from one another to provide a unique user workout.

In an alternative embodiment, flexible member 101 will be telescoping. That is, it will be collapsible such that the present invention may be transported or stored easily. Additionally, this embodiment provides for customizable lengths, such that multiple users may have the optimal benefit of the present invention. In other embodiments, flexible member merely folds in half to increase portability and ease of storage.

In a preferred embodiment, the present invention further comprises a means 125 for attaching a cell phone 130 as shown in FIG. 1. This could be with a clip sized for the phone 130, a mesh pouch that can hold the phone 130, an indentation sized to fit the phone 130, a clamp, a claw, a plurality of hook and loop fasteners, at least one strap, and the like. The addition of a mobile phone would create the ability to record stick movement (and other measurements via a mobile application) which may provide an overseeing physician/physical therapist insight as to the compliance rate and progression of the patient. Further, this incorporation could measure angles of bends and amounts of exercises being done could be important in the comprehensive evaluation of the user by an orthopedist. The present invention also contemplates a series of therapeutic sticks having various thicknesses and lengths as well as a travel bag for the therapeutic stick.

Further, other attachments or add-ons may be utilized including but not limited to vibrating elements, weights, elastic bands, heating elements, cooling elements, resistance attachments and the like or varying combinations thereof. The sticks may be sold in packages providing varying sizes, resistances, etc. to provide a more complete and unique workout.

In a preferred embodiment, the therapeutic stick will be significantly smaller, ranging from 16" to 24" in length. This smaller version is beneficial when used during travel, as it is sized to be easily stored in a carry-on bag. In yet another preferred embodiment, two therapeutic sticks are combined. This embodiment has the additional benefit of providing additional resistance.

There exists a number of embodiments for the method of use of the therapeutic stick of the present invention. This is because almost every muscle in the human body can be exercised with this therapeutic stick, although certain exercises will only target certain groups. For example, to target the pectoral, trapezius, rhomboids, rotator cuff and deltoid muscle groups, the forward stroke and the backward stroke exercise should be performed. Additionally, to target the lower back, hamstring muscle group, and gluteus muscle group, the forward bend exercise must be performed. This has the additional benefit of mobilizing the user's erector spinae.

The muscles of the arm (biceps, radials, wrist extensors, wrist flexors, hand intrinsics), are targeted with side arm extensions with subsequent rotations. The trapezius, tricep, rhomboid, obliques, lats, and teres major can be targeted with upper arm extensions with a side bend (similar to half-moon yoga pose). The glenohumeral joint can also be mobilized through use of the present invention. Additionally, the abductor, tranversus abdominus, motifidi, obliques, quads, hip flexor, hamstrings, gluteus maximus can be stretched and strengthened through use of the therapeutic stick of the present invention. The scalenes, sterno cleido mastoid, (SCM) deep neck flexors of a user can be stretched and strengthened with a neck bend/twist. The rectus abdominus, obliques, and pectorals can be stretched and strengthened by a shoulder mounted back bend. The abductors, glutes, obliques, lumbar spine extensors, quads, hamstrings can be exercised by a trunk twist; the rotator cuff, pectorals, biceps can be exercised with a rotator flex; and to mobilize the thoracic facet joints, a thoracic extension may be employed.

To stretch the longus colli and longus capitis, while also mobilizing the cervical spine, a cervical extension should be performed. One can stretch the hamstrings, glutes, quads via a one- or two-stick squat, and may stretch/strengthen the hip abductor, gluteus maximus, hip flexor, hip rotator, core stabilizers, via leg circles. A user's gastrocnemius, soleus, tibealus posterior, and peronials, may be stretched with a heel raise, and the user's tibealus anterior, gatrocnemius, soleus may be exercised with a toe raise. One may also rotation their sideline lumbar via a perctoral stretch, and may stretch and strengthen their thoracic spine, hips, and glutes via kneeling trunk twist.

A non-exhaustive list of exercises that can be performed with the therapeutic stick of the present invention include: twist 1/r; side bend 1/r; front bend; rear bend; front left turn and bend; front right turn and bend; rear left turn and bend; rear right turn and bend; front short arm/shoulder rows; rear short arm/shoulder rows; right stick strike; left stick strike; forward arm raise; rear arm raise; rotator raises; front swim; rear swim; extended left arm in air stretch; extended right arm in air stretch; knee raise; heel raise; toe raise; rear arm front shoulder door stretch; shoulder bends elbows in n out; crouches; behind back tricep pulls; leg crosses all directions; neck extensions 1/r; squat; bicep curls; bend n curl back; in out up down arm; front tricep pull; shrugs; hips 1/r in/out circle; arm strtch back bend/fowrd bend; chin dips; chin tucks; neck bends; neck turns; behind back scapula rub; tricep and armpit rub; behind back bend w resistance for forward ab flex stick is center body; knee bends; bear slap; forward bend curl up; behind neck elbow twists; right angle bend for shoulders and back (feet rt angle); front bend for shoulders back; behind back chest stretch; sideline lumbar rotation; thoracic extension; double stick front knee raise/leg extension; double stick squats; leg circles front/rear/sides; supported front lumbar/hamstring stretch; supported front lat stretch; arm extension with rotation; rotator flex; simulated throwing; assisted extended arm/shoulder twists; kneeling trunk twists; knee raise w abductor flex; pectoral flex with bent arm; two handed center mixer left/right; one handed mixer left/right; arm across chest stretch; under arm shoulder stretch; lumbar stretch; hip rotations; knee bend the extension kick; oar row; wrist flexes; sitting crossed leg groin stretch; sitting groin stretch; assisted lunge; lying knee to chest; standing knee to chest; shift arm exercise It should be noted that the majority of these exercises are designed to be stretches for flexibility and joint mobility and/or continuous movements for strength and aerobics and that whether a user is standing, sitting, or lying down will have an effect on the exercises. Further, a change of position, such as bending the arm or leg instead of having them fully extended, will change which groups of muscles that are used. Additionally, many of the embodiments of the method of the present invention can be performed utilizing one or two therapeutic sticks of the present invention.

Further, such exercises and massages listed above, and others not named explicitly herein, may provide for increased blood flow to promote healing of injuries and the like. T therapeutic stick can also be used to engage muscles causing variable macro and micro muscle contraction and relaxation by using variable resistance and angles. In addition, such an apparatus may be able to be used in under water conditions or in zero gravity environments.

In some embodiments the therapeutic stick is straight, while in other embodiments it is contoured to a particular design.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A therapeutic stick, comprising:

a linear, flexible member having a length, a diameter, a first end and a second end, wherein said linear, flexible member is enveloped by padding;

a first auxiliary grip, disposed proximate to said first end;

a second auxiliary grip, disposed proximate to said second end;

a first primary grip, disposed on said first end; and a second primary grip; disposed on said second end;

wherein the first primary grip and the second primary grip are spherical grips with a wedge portion removed from each of the first primary grip and the second primary grip.

2. The therapeutic stick of claim 1, wherein said first primary grip or said second primary grip are removably attached to said linear, flexible member.

3. The therapeutic stick of claim 1, wherein said first primary grip and/or said second primary grip have a 3" diameter, and at least 25% of their area removed.

4. The therapeutic stick of claim 3, wherein said first primary grip and/or said second primary grip are adapted to conform to a given user's hand.

5. The therapeutic stick of claim 1, further comprising a mechanism configured to couple a mobile phone to said therapeutic stick.

6. The therapeutic stick of claim 5, further comprising a mobile phone attached to said mechanism, wherein said mobile phone contains instructions about how to use said therapeutic stick.

7. The therapeutic stick of claim 1, wherein said first primary grip and said second primary grip are rotatably attached to said linear, flexible member.

8. The therapeutic stick of claim 1, wherein said linear, flexible member includes material selected from the group consisting of: aluminum, PVA, PVC, fiber glass, carbon fiber, brass, and wood.

9. The therapeutic stick of claim 1, wherein said length is substantially 80% of a user's wingspan.

10. The therapeutic stick of claim 1, wherein said padding is disposed with at least one indicator, wherein said at least one indicator corresponds to a particular level of resistance.

11. The therapeutic stick of claim 1, wherein said first auxiliary handle and said second auxiliary handle are substantially enveloped by a rubber sleeve.

12. A method of regaining flexibility, comprising the steps of:

a. providing a therapeutic stick, comprising:

a linear, flexible member, having a length, a diameter, a first end and a second end, a first auxiliary grip, disposed proximate to said first end, a second auxiliary grip, disposed proximate to said second end, a first primary grip, disposed on said first end, a second primary grip, disposed on said second end; and wherein the first primary grip and the second primary grip are spherical grips with a wedge portion removed from each of the first primary trip and the second primary grip;

b. selecting a muscle or group of muscles to be stretched;

c. determining at least one exercise to be performed with said therapeutic stick; and d. performing said at least one exercise for a predetermined amount of time.

13. The method of claim 12, wherein said group of muscles comprises pectoral, trapezius, rhomboid, rotator cuff, or deltoids, and said at least one exercise is selected from the group consisting of: forward stroke and backwards stroke.

14. The method of claim 12, wherein said group of muscles comprises lower back, hamstring group, or gluteus group and said at least one exercise is supported forward bend.

15. The method of claim 12, wherein said group of muscles comprises arm muscles and said at least one exercise is side arm extensions with rotation.

16. The method of claim 12, wherein said group of muscles comprises trapezius, tricep, rhomboid, obliques, lats, or teres major and said at least one exercise is upper arm extension with side bend.

17. The method of claim 12, wherein said group of muscles comprises abductor, tranversus abdominus, motifidi, obliques, quads, hip flexor, hamstrings, or gluteus maximus and said at least one exercise is selected from the group consisting of: front kick, side kick, and rear kick.

18. The method of claim 12, wherein said group of muscles comprises rectus abdominus, obliques, or pectorals and said at least one exercise is shoulder-mounted back bend.

19. The method of claim 12, wherein said group of muscles comprises rotator cuff, pectorals, or biceps and said at least one exercise is selected rotator flex.

20. The method of claim 12, wherein said group of muscles comprises hip abductor, gluteas maximus, hip flexor, hip rotator, and core stabilizers and said at least one exercise is leg circles.

21. The method of claim 12, wherein said group of muscles comprises gastrocnemius, soleus, tibealus posterior, or peronials, and said at least one exercise is heel raises.

22. The method of claim 12, wherein said group of muscles comprises Tibealus anterior, gastrocnemius, or soleus, and said at least one exercise is toe raises.

23. The method of claim 12, wherein said group of muscles comprises Thoracic spine, hips, or glutes, and said at least one exercise is kneeling truck twists.

24. The method of claim 12, wherein said therapeutic stick acts as an acupressure point activator for pain relief and induces increased blood flow.

25. The method of claim 12 wherein said method may be performed in regular or zero gravity environments.

26. The method of claim 12 wherein the therapeutic stick can be used to engage muscles, causing variable macro and micro muscle contraction and relaxation by using variable resistance and angles.

27. The method of claim 12 wherein the therapeutic stick is used to massage targeted areas to encourage healing blood flow to flow to the targeted areas.

* * * * *